United States Patent [19]

Kurt

[11] 4,084,646

[45] Apr. 18, 1978

[54] FLUID ACTUATED IMPACT TOOL

[75] Inventor: Ewald Heinz Kurt, Phillipsburg, N.J.

[73] Assignee: Ingersoll-Rand Company, Woodcliff Lake, N.J.

[21] Appl. No.: 659,425

[22] Filed: Feb. 19, 1976

[51] Int. Cl.[2] ..... H01B 17/54

[52] U.S. Cl. ..... 173/17; 91/234; 173/73; 173/137

[58] Field of Search ..... 91/232, 234, 235; 173/17, 64, 73, 135, 137

[56] References Cited

U.S. PATENT DOCUMENTS

| | | | |
|---|---|---|---|
| 537,646 | 4/1895 | Rinsche | 91/232 |
| 692,388 | 2/1902 | Vaughan | 91/234 |
| 1,128,416 | 2/1915 | Crump | 173/17 X |
| 1,211,049 | 1/1917 | Bayles | 91/232 X |
| 1,849,208 | 3/1932 | Slatcher | 91/234 X |
| 2,947,519 | 8/1960 | Feucht | 173/73 |
| 3,136,375 | 6/1964 | Lear et al. | 173/64 X |
| 3,241,239 | 3/1966 | Ellis | 91/234 X |
| 3,410,353 | 11/1968 | Martini | 173/73 |
| 3,606,930 | 9/1971 | Curington | 173/17 X |
| 3,804,181 | 4/1974 | Curington et al. | 173/17 |

FOREIGN PATENT DOCUMENTS

| | | | |
|---|---|---|---|
| 120,480 | 5/1958 | U.S.S.R. | 91/232 |
| 307,184 | 5/1972 | U.S.S.R. | 173/73 |

*Primary Examiner*—Lawrence J. Staab
*Attorney, Agent, or Firm*—Walter C. Vliet

[57] ABSTRACT

A fluid actuated impact tool is disclosed of the type commonly known as a down-the-hole drill for drilling of rock. The tool is provided with a reversible casing which serves the dual functions of a casing and cylinder. A partial cylinder sleeve is utilized in conjunction with exhaust rod porting to provide a drill which is simple in construction, has a high energy level of output, and eliminates the need for expensive cross porting or axial porting in the parts most subject to wear; that is, the impact piston and the casing. All of the porting in the casing is accomplished by means of circumferential grooves which are readily machined.

30 Claims, 7 Drawing Figures

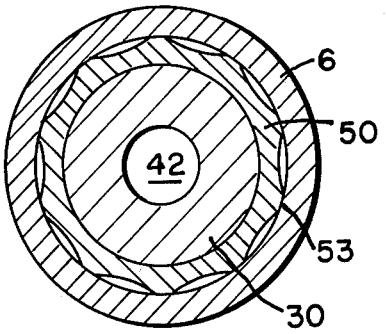
FIG. 2
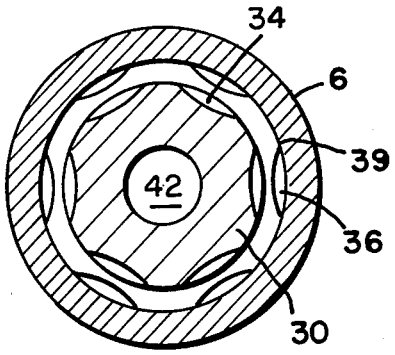
FIG. 3
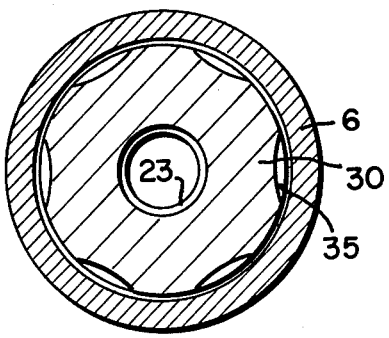
FIG. 5
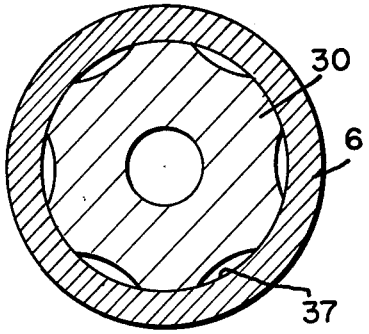
FIG. 4
FIG. 6
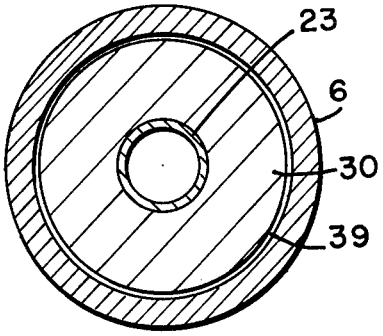

FLUID ACTUATED IMPACT TOOL

BACKGROUND OF THE INVENTION

This invention relates to pressure fluid operated impact tools particularly adapted for use in mechanically operated drills of the percussive type such as used in rock drilling and similar operations. The invention is particularly adapted to those applications where the diameter of the drill body is limited as for instance those cases where the drill is adapted to follow the drill bit down the drill hole. In such cases, of course, the diameter of the drill is limited by the diameter of the drill bit and it must be somewhat smaller not only to get into the drill hole but to permit the escape of drill cuttings.

Three of the primary considerations for such drills are high energy output, simplicity and reliability of construction, and ease and cost of replacing parts worn by impacting or abrasion. It is accordingly an object of this invention to provide a fluid actuated impact tool of the type described which is powerful, of simple and reliable design, and constructed in such a manner as to permit ready disassembly and replacement parts. It is a further object of this invention to provide an impact tool having a minimum of parts and constructing such parts as are required in a manner which minimize their difficulty of fabrication and cost. It is an object of this invention to eliminate as much as possible off center axially drilled porting and to replace it where possible with surface machined porting such as circumferentially machined grooves.

It is a further object of this invention to obtain maximum energy output from the impact piston by having it strike directly on the percussive bit and further to apply a constant pressure in the direction of impact on the outer surface of the piston. The impact mechanism is comprised of only one moving part and all valving of the pressure fluid is accomplished by the unique internal and external porting of the piston. It is a further object of the invention to provide a casing which is reversible to obtain maximum life utilization. By reversing the casing, it is allowed to experience the maximum wear near the bit on both ends of the sleeve.

Accordingly, it is an object of this invention to provide a percussive drill apparatus comprising: a casing extending substantially the length of the drill apparatus; a backhead disposed at one end of the casing for connecting the drill apparatus to a drill string and source of pressure fluid; a distributor disposed within the casing at one end of the casing; a percussive member disposed at the other end of the casing to form a chamber between the distributor and the drill bit within the casing; a cylinder sleeve disposed with radial clearance in the chamber toward one end to form an annular passageway; and a piston disposed in the chamber for reciprocating axially therein and imparting a blow on the drill bit; the piston being in sliding contact with the cylinder sleeve towards one end and in sliding contact with the casing towards the other end. Other objects and advantages of the construction will be in part pointed out and in part obvious hereinafter in the description of the preferred embodiment illustrated and in the drawing.

BRIEF DESCRIPTION OF THE DRAWINGS

FIG. 2 is a cross sectional view of the impact tool taken at a section 2—2 shown on FIG. 1.

FIG. 3 is a cross sectional view of the impact tool taken at a section 3—3 of FIG. 1A.

FIG. 4 is a cross sectional view of the impact tool taken at a section 4—4 shown on FIG. 1A.

DESCRIPTION OF THE PREFERRED EMBODIMENT

Figure 1:
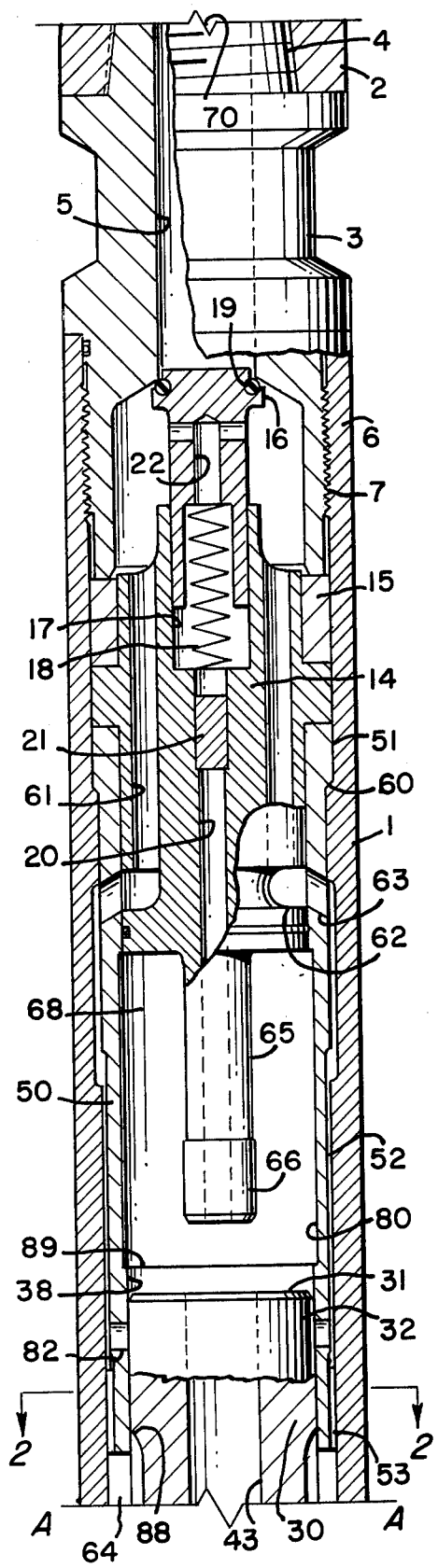
FIG. 1 is a longitudinal section of the rear part of a fluid actuated impact tool as applied to a pneumatic down-the-hole rock drill.

Referring to FIG. 1; the upper half of a fluid actuated impact tool is shown and is designated generally by reference numeral 1. The preferred embodiment herein chosen is that of a pneumatic down-the-hole rock drill. This device is adapted to be suspended in the hole to be drilled by means of appropriate drill steel 2. The drill is provided with a backhead coupling 3 which couples the drill steel to the remainder of the drill body. The backhead coupling 3 is provided with a mating threaded section 4 which holds the backhead coupling 3 to the drill steel 2. The backhead coupling 3 has a central bore 5 through which pneumatic pressure fluid is supplied from drill steel 2 to the remainder of the drill. A casing 6 is threadably engaged at one end by means of casing threads 7 to the backhead coupling 3. A percussive drill bit 8 is disposed in its supporting chuck 9, shown on FIG. 1A. The supporting chuck 9 is threadably engaged with the casing 6 at its other end by means of casing threads 7.

The percussive drill bit 8 is mounted within chuck 9 to allow restricted axial movement of the percussive drill bit 8. The axial excursion of percussive drill bit 8 is limited by means of split retaining ring 10. The percussive drill bit 8 is driven in a rotary direction by the drill steel 2, backhead couping 3, casing 6, chuck 9, and finally in turn drive pin 11. The nature of this drive is similar to, and will more readily be understood by referring to U.S. Pat. No. 3,517,754 issued June 30, 1970, to R. W. Hughes, and assigned to Ingersoll-Rand Company. A compression ring 12 and a spacer ring 13 complete the mounting and guiding elements for the percussive drill bit 8.

Referring again to FIG. 1; a distributor 14 is disposed within casing 6 towards the end of the drill near the backhead coupling 3. The distributor slides into the casing 6 when the backhead coupling 3 is removed. When the backhead coupling 3 is screwed into place by means of casing threads 7, collar 15 serves to retain the distributor in place. The distributor 14 is provided with a check valve 16 which serves to prevent a reverse flow of pressure fluid and/or foreign particulate matter back into the drill string. A check valve 16 is disposed within a bore 17 formed within the distributor 14. A spring 18 serves to bias the check valve towards its closed position in contact with the central bore 5 of the backhead coupling 3. An "O" ring seal 19 is provided between the check valve 16 and the backhead coupling 3. The check valve 16 is further provided with a T-shaped passageway 22 which provides access for pressure fluid to the bore 17. An axially bored passageway 20 is provided in the distributor. This passageway provides a means for communicating pressure fluid directly through the distributor to the remainder of the impact apparatus which will now be described.

The amount of flow through the axially bored passageway 20 is regulated by means of orifice plug 21. In the case of preferred embodiment a solid orifice plug 21 is provided and no pressure fluid flow is permitted through axially bored passageway 20. In some types of rock or soil conditions, it is desirable to provide a continuous or increased purge of pressure fluid through the impact tool. This is accomplished by removing orifice plug 21 or providing it with a calibrated drilled bore (not shown).

Impact Mechanism

The primary source of impact for the drill is provided by piston 30. Piston 30 is reciprocated within the chamber formed in the casing by the distributor 14 at one end and by the percussive drill bit 8 at the other end. Between these two extremes, the piston is allowed to reciprocate as controlled by the introduction of pressure fluid. The piston of the drill is a dual diameter piston 30 having a smaller diameter portion and a larger diameter portion joined by shoulder 34. The piston has an upper pressure surface 31 on the reduced diameter portion of the piston and an impact imparting or hammer surface 40 on its lower or increased diameter end. The piston has an outside circumferential sealing surface 32 on its reduced diameter portion and an outside circumferential sealing surface 39 on its lower diameter portion. Axial porting slots 33 are provided on the reduced diameter portion of the piston starting an appreciable distance from the upper end of the piston and running to the shoulder 34. Axial porting slots 36 are provided on the larger diameter portion of the piston starting an appreciable distance from the hammer surface on the lower end and intercepting shoulder 34. The slots 33 and 36 provide a means for pressure fluid to move axially along the outside portion of the piston except at its ends while the piston is guided on the cylinder sleeve 50 and the casing 6. The end of the piston not being slotted serves as seals against the flow of pressure fluid when in contact with internal surfaces of the cylinder sleeve 50 or casing 6. An impact imparting or hammer surface 40 is disposed on the lower end of the piston 30. This strikes impact receiving or anvil surface 41 of the percussive drill bit 8 when a blow is struck by the piston 30 on the percussive drill bit 8.

The piston 30, like the distributor 14, is provided with an axial bore 42. The axial 42 is provided with an internal sealing surface 43 at its upper end and an internal sealing surface 44 at its lower end. The cylinder sleeve 50 is also disposed within the casing 6 and forms essentially a concentric sleeve within a sleeve in the portion of the casing near the distributor. The cylinder sleeve is free to slide in the casing when the distributor 14, collar 15, and backhead coupling 3 are removed. It is held in place as shown on FIG. 1. Axial movement towards the other end or the end towards the percussive drill bit is prevented by means of an increased diameter portion or a boss 51 which contacts a ridge 60 in the casing 6. An annular passageway 52 is formed by radial clearance between the cylinder sleeve 50 and casing 6. The cylinder sleeve is retained in concentric orientation by means of boss 51 and the lands 53 at the lower end of the cylinder sleeve 50. The function of lands 53 will best be understood by referring to FIG. 2. The piston 30 is similarly provided with lands to allow axial flow of pressure fluid while guiding on the inner surface of the cylinder sleeve 50 (see FIG. 3) and the internal surface 37 of the casing 6 (see FIG. 4). FIGS. 5 and 6 also serve to show the piston cross section at various elevations along its length (refer to FIG. 1A).

Valving and Porting

Distributor 14 is provided with a series of longitudinal bore holes 61 which communicate pressure fluid from the inlet 70 to a circumferential undercut 62 formed near the lower end of the distributor 14. Circumferential undercut 62 is aligned with drilled ports 63 in the cylinder sleeve 50. By the aforementioned passageways and ports, pressure fluid may flow to the annular passageway 52 around the cylinder sleeve 50. Following the annular passageway 52, the pressure fluid may enter the chamber 64 formed by the casing 6, piston 30, and the cylinder sleeve 50. As long as pressure fluid is applied to inlet 70, a constant supply of pressure fluid is supplied to this chamber by the passageway described. Distributor 14 is provided with a exhaust rod 65 which has an enlarged head and sealing surfaces 66. When the piston 30 has moved sufficiently towards the distributor to engage the exhaust rod 65, enlarged head and sealing surfaces 66 and the internal sealing surface 43 cooperate to close off axial bore 42 from any pressure fluid that may be supplied to it from the upper end of chamber 64.

In similar manner, percussive drill bit 8 is provided with a exhaust tube 23 which cooperates with the sealing surface 44 of the piston 30 to prevent pressure fluid from entering the exhaust bore 67 of the percussive drill bit 8 when the piston 30 is towards the other or percussive bit end. A series of circumferential grooves in both the casing 6 and the cylinder sleeve 50 cooperate with the piston 30 depending on its position to either pass or prevent the flow of pressure fluid to chambers formed at the opposite ends of the piston. The function of these circumferential grooves in cooperations with the sealing surfaces previously described will become apparent as their function is described in the operation of the impact tool which follows.

In operation, air at from 100 psi to 250 psi (depending on the supply available) enters the drill at inlet 70 in the backhead from the drill steel. The air pressure forces the check valve 16 to move forward against the spring 18 which holds it on its seat when no air is applied to the drill. The air passes around the check valve 18 and then into the distributor 14 via six longitudinal bore holes 61. These holes terminate in an undercut 62 in the distributor. From this undercut the air passes through six drilled ports 63 in the cylinder sleeve 50 into an annular passageway 52 between the outside diameter of the cylinder sleeve 50 and the inside of the casing 6.

From here the air moves forward into chamber 64 between the piston outside surface 33 and the casing 6 inside diameter. This is an "air reservior space" because there is always pressure fluid in this chamber and it is from here that the air passes either to the upper chamber 68 of the piston or the lower chamber 69 of the piston. With the piston in its lower position (shown in FIG. 1 and 1A) which it would attain before the air is turned on, the air passes into the lower chamber 69, exerting a force on the lower impact imparting surface 40 of the piston 30, driving it upwards towards its one or inlet end. The air continues to feed into the lower chamber 69 until the lower sealing surface 39 of the piston contacts the internal surface 37 of the casing, that is, until edge 86 contacts shoulder 87. When this occurs, air is shut off to the lower chamber 69. The piston continues to move upwards, however, by virtue of its velocity and the expansion of the air in the lower chamber. As the piston rises, the lower sealing surface 44 of the axial bore 42 of piston 30 pulls off the end of the exhaust tube 23. At this point, the air in the lower chamber 69 exhausts into the drill bit 8 and out into the exhaust bore 67.

While this is going on at the lower end of the piston, other events are occurring at the upper end. The first is that the upper chamber 68 is sealed off as the sealing surface 43 of the piston axial bore engages the lower end of the enlarged head 66 of the exhaust rod 65 of the distributor. Shortly thereafter, pressure fluid is admitted into the upper chamber 68 as edge 88 of the piston slots 36 uncover the shoulder 89 of the undercut 80 inside the cylinder sleeve 50. The air entering the upper chamber 68 first stops the piston on its upwards travel (about an inch from hitting the distributor) and then reverses the piston travel, pushing it forward at increasing velocity. The pressure fluid flow to the upper chamber 68 is shut off as edge 88 of the piston slots 36 cover the shoulder 89 of the undercut 80. From this point on, the piston is driven by expanding pressure fluid. When sealing surface 43 looses contact with enlarged head 66 of the distributor exhaust rod, air in the upper chamber 68 is exhausted through the piston 30, into the exhaust tube 23 and out the bit 8. The piston continues to move towards its other end until edge 86 of the lower sealing surface 39 of the piston 30 looses contact with the shoulder 87 of internal surface 30 of the casing again at which point air re-enters the lower chamber 69. Shortly thereafter, the piston 30 impacts against the bit 8. The piston rebounds somewhat. This, plus the air re-entering the lower chamber, starts the next cycle.

If additional air is required to clean the chips out of the hole, the orifice plug 21 can be removed, or provided with a calibrated bore, causing air to blow into the exhaust system continuously, supplementing the air exhausted by the piston motion. When the drill is pulled out of the hole, the bit will fall to a position lower than that shown in FIG. 1 as limited by split retaining ring 10 when it contacts edge 81. The bit can then fall no further. As the bit falls, and the piston follows it, three things happen. First, the upper end of the piston 30 uncovers a series of holes 82 in the cylinder sleeve. This causes the pressure fluid to enter the upper chamber 68 and blow freely into the exhaust system. Secondly, the lower edge 90 of sealing surface 39 contacts the internal surface 37 of the casing at shoulder 91 thus preventing pressure fluid from entering the lower chamber 69. Thirdly, the lower edge 92 of the bit slots 83 uncover the shoulder 84 in the spacer ring 13, causing the pressure fluid trapped in the lower chamber 69 to be vented to the outside through the chuck 9. With no air admitted to the lower chamber 69 and that which was trapped there vented out, there is no force to raise the piston 30 so cycling stops and the drill goes into its "blow" position. It is called the "blow" position because air is blown through the holes 82 into the exhaust and then out into the hole drilled in the rock. If the bit is pushed against the rock again, the piston will be lifted, which causes the vent to be closed off, the holes 82 to be closed off and air to re-enter the lower chamber 69. The drill then begins to cycle in the normal way.

The advantages of this construction are: The piston driving force is comprised of a combination of constant air to the outer circumferential surface which acts on lands 34 and 35 to cause a constant downward force, and expanding air operating on upper pressure 31. As a result, the average force against the piston on its downstroke is somewhat higher than for conventional drills which exhaust this area.

Figure 1A:
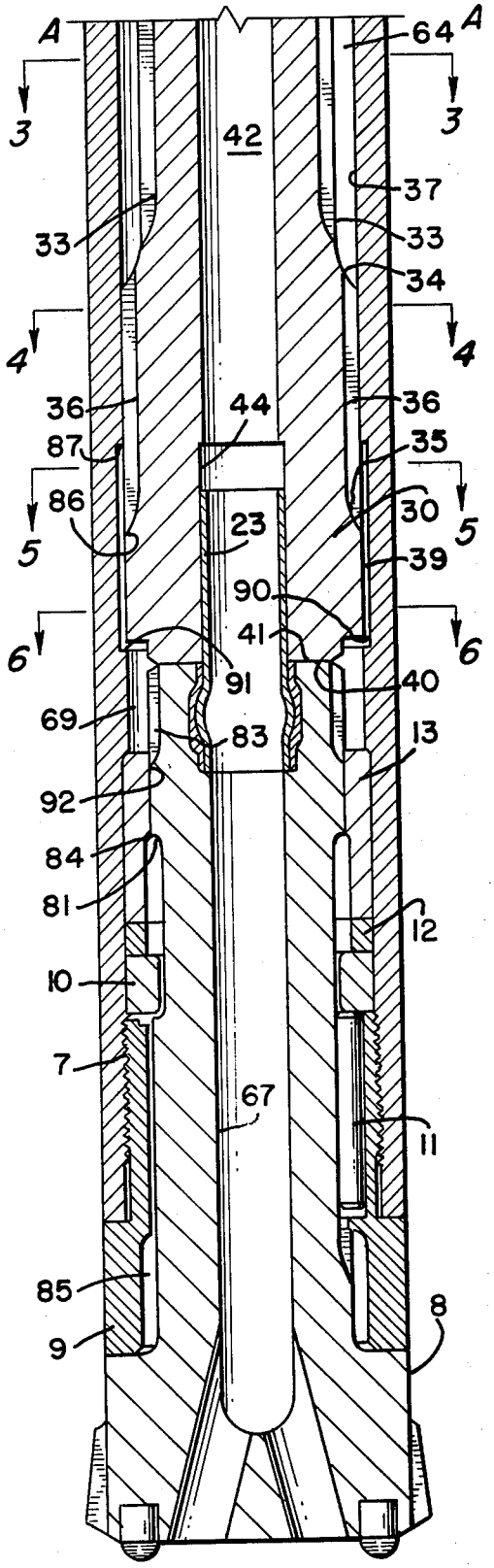
FIG. 1A is a continuation of the forward part of the drill shown in FIG. 1 and shows the end of the piston, its casing, and the percussive drill bit which it is adapted to strike.

In addition, no holes are required in the piston or in the casing for porting. The casing, which is an expendible item because of the abrasive wear due to the chip flow up the hole, becomes a less expensive replacement part. By placing the upper and lower casing undercuts symmetrically as shown in FIG. 1 and 1A, the casing becomes reversible.

While we have shown the percussive drill bit 8 as a single integral piece in the preferred embodiment, it should be obvious to one skilled in the art and common practice in the art to divide the bit into two or more separable parts, for example, a shank or anvil upper portion and a cutter bit or head. In addition, it is common practice to reverse the mounting of the exhaust rod and exhaust tube that is either or both may be a part of the piston with appropriate mating sealing surfaces designed within the distributor or the drill end. Each of these modifications is considered structural and functional equivalents of the structure described.

Having described the invention, numerous other modifications will occur to one skilled in the art. I do not wish to be limited in the scope of my invention as the same will now be understood except by the scope of the claims.

I claim:

1. A percussive drill apparatus of the valveless type adapted for downhole drilling comprising:

a casing;

a backhead disposed at one end of said casing adapted to connect the drill apparatus to a drill string and a source of pressure fluid;

a distributor disposed within said casing towards said one end of said casing;

a percussive member disposed at the other end of said casing to form a chamber having one end disposed towards said distributor and a second end disposed towards said percussive member between said distributor and said percussive member within said casing;

a cylinder sleeve disposed in said chamber toward said one end of said chamber;

a first pressure fluid passage formed between said casing and said cylinder sleeve to connect the pressure fluid source to said chamber;

a piston disposed in said chamber to reciprocate axially therein and impart a blow on said percussive member; said piston is in sliding contact with said cylinder sleeve adjacent said one end of said chamber and in sliding contact with said casing adjacent said second end of said chamber;

a means for continuously applying pressure fluid to a selected portion of said one side of said piston to thereby provide a continued driving force on said piston towards said second end of the chamber;

a means for alternately supplying and exhausting pressure fluid to a selected portion of one side of said piston disposed towards said one end of said chamber and to a selected portion of the other side of said piston disposed towards said second end of said chamber to thereby reciprocate said piston; and said means for alternately supplying and exhausting pressure fluid to said one side of said piston includes a second pressure fluid passage extending from said first pressure fluid passage along the interior of said sleeve and the exterior of said piston.

2. The apparatus of claim 1 wherein:

said means for alternately supplying and exhausting pressure fluid includes a finger valve and an exhaust tube valve.

3. The apparatus of claim 1 wherein:

said distributor is provided with a finger valve projecting into said chamber;

said percussive member is provided with an exhaust tube valve; and said piston alternately cooperates with said finger valve and said exhaust tube valve to permit pressurization and exhaust of the chamber portions on either side of said piston.

4. The apparatus of claim 1 wherein:

said casing forms a portion of said chamber.

5. The apparatus of claim 1 wherein:

said distributor is provided with a check valve to prevent back flow through said percussive drill.

6. The apparatus of claim 1 wherein:

said distributor is provided with a central bore for providing a constant flow of pressure fluid to said percussive means.

7. The apparatus of claim 1 wherein:

said piston is provided with a central bore for exhausting said one end of said chamber when said piston is located towards said second end of said chamber and for providing a constant flow of pressure fluid to said percussive bit.

8. The apparatus of claim 1 wherein:

said pressure fluid passage is an annular supply passage between said cylinder sleeve and said casing.

9. The apparatus of claim 1 wherein:

said piston and said casing are positioned and adapted to shut off pressure fluid flow to said other side of said piston and said piston and said cylinder sleeve are positioned and adapted to shut off pressure fluid flow to said one side of said piston, and said piston has external axial porting slots and a central bore and is otherwise solid without any passages having a direction with a radial component.

10. The apparatus of claim 1 wherein:

port means are provided in said cylinder sleeve to allow pressure fluid flow to said percussive means at anytime said percussive means is moved from a first operating position located towards said chamber to a second blowing position located axially away from said chamber.

11. A percussive drill apparatus of the valveless type adapted for downhole drilling comprising:

a casing;

a backhead disposed at one end of said casing and adapted to connect the drill apparatus to a drill string and source of pressure fluid;

a distributor disposed within said casing towards said one end of said casing;

a percussive member disposed at the other end of said casing to form a chamber having one end disposed towards said distributor and a second end disposed towards said percussive member between said distributor and said percussive member within said casing;

a cylinder sleeve disposed in said chamber toward said one end of said chamber;

a pressure fluid passage formed between said casing and said cylinder sleeve positioned to supply pressure fluid to said chamber;

a piston disposed in said chamber to reciprocate axially therein and impart a blow on said percussive member; said piston in sliding contact with said cylinder sleeve adjacent said one end of said chamber and in sliding contact with said casing adjacent said second end of said chamber; and a means for alternately supplying pressure fluid to at least a portion of one side of said piston disposed towards said one end of said chamber and to at least a portion of the other side of said piston disposed towards said second end of said chamber; and said casing contains internal circumferential grooves forming porting and is generally symmetrical about a central bore to thereby be reversible end to end.

12. A downhole drill apparatus of the type adapted to be driven by an external pressure fluid source comprising:

a casing;

a backhead disposed at one end of said casing;

an impact receiving device disposed at the other end of said casing;

a reciprocating piston in said casing positioned and adapted to impart a blow on said impact receiving device;

said piston having a central bore and no other internal passages having a direction with a radial component;

a means for alternately supplying pressure fluid to at least a portion of one side of said piston disposed towards said one end of said chamber and to at least a portion of the other side of said pistion disposed towards said second end of said chamber to thereby reciprocate the piston; and a means for continuously applying pressure fluid to at least one portion of said piston facing towards said one end of said casing whereby said piston is more rapidly accelerated in the direction towards said other end of said casing to impart a greater blow on said impact receiving device.

13. A percussive drill apparatus comprising:

a casing;

a backhead disposed at one end of said casing adapted to connect said drill apparatus to a drill string and source of pressure fluid;

a distributor disposed in said casing towards said backhead adapted to direct the flow of pressure fluid;

a cylinder sleeve disposed in said casing towards said distributor adapted to direct the flow of pressure fluid from said distributor;

a percussive member disposed at the other end of said casing;

said distributor, said cylinder sleeve, said casing, and said percussive means positioned and adapted to form a chamber therebetween;

a reciprocating piston disposed in said chamber and having a greater and lesser diameter joined by a shoulder;

said piston partially in sliding contact with in said cylinder sleeve and partially in sliding contact with said casing;

said lesser diameter of said piston and said cylinder sleeve positioned and adapted to form alternately a seal and a flow path for said pressure fluid to the portion of said chamber located towards said distributor and said greater diameter of said piston and said casing adapted to form alternately a seal and flow path for said pressure fluid to the portion of said chamber located towards said percussive means;

a means for continuously supplying pressure fluid to the portion of said chamber located intermediate the seals formed by said lesser and said greater diameters of said piston whereby constant pressure is applied to the shoulder of said piston to provide a constant force acting on said piston towards said percussive member; and said casing is provided with circumferential internal grooves connected to carry pressure fluid and said casing is symmetrical end for end to thereby allow reversal of said casing in said apparatus.

14. The apparatus of claim 13 wherein:

said backhead is threadingly connected to said casing and serves as a retainer for said distributor.

15. The apparatus of claim 13 wherein:

said distributor is provided with both central and peripheral pressure fluid passageways.

16. The apparatus of claim 13 wherein:

said distributor is provided with a check valve means to permit flow of pressure fluid in one direction only.

17. The apparatus of claim 13 wherein:

said distributor is provided with a finger valve which cooperates with a bore in said piston to permit alternate pressurization of the portion of said chamber located towards said distributor.

18. The apparatus of claim 13 wherein:

said cylinder sleeve cooperates with said distributor to further peripherally distribute pressure fluid.

19. The apparatus of claim 13 wherein:

said piston includes a longitudinal bore and is provided with smooth sealing surfaces both internally at each end of said bore and externally on the periphery of each end of said piston.

20. The apparatus of claim 19 wherein:

said piston is provided with peripheral longitudinal passageways other than at each end of said piston.

21. The apparatus of claim 13 wherein:

said cylinder sleeve is provided with a circumferential internal groove which serves as a pressure fluid passageway when said piston is located towards said distributor.

22. The apparatus of claim 13 wherein:

said percussive member is a rock drill bit slidingly retained in said casing.

23. A percussive drill apparatus of the valveless type adapted for downhole drilling comprising:

a casing;

a means for applying pressure fluid to said casing at one end of said casing;

a cylinder sleeve disposed in said casing towards said one end;

a piston in said casing in sliding contact with said cylinder sleeve at one end of the piston and in sliding contact with said casing at the other end of the piston;

a percussive member at the other end of said casing for receiving an impact from said piston;

said cylinder sleeve, piston, and casing adapted to form a passageway and to distribute pressure fluid continuously, from said means for applying pressure fluid to said casing, along the outside periphery of the cylinder sleeve towards said other end of said casing and intermittently along the inside circumference of the cylinder sleeve and the exterior of said piston to said one end of said piston;

a valving means in said passageway for alternately supplying pressure fluid to said one end of said piston and to the other end of said piston to impart a reciprocating motion thereto;

said piston is a stepped piston having more than one force producing area;

said piston has a central bore and said valving means comprises a finger valve cooperating with the bore in said piston, and said valving means comprises an exhaust tube valve cooperating with the bore in said piston; and said valving means comprises a means for continuously applying pressure fluid to a portion of said stepped piston so as to provide a constant driving force on said piston acting towards said percussive member.

24. The apparatus of claim 23 wherein:

said percussive member has an extended non-operating position whereby pressure fluid is continuously vented from said casing.

25. The apparatus of claim 23 wherein:

said percussive member has a retracted operating position in which a chamber between said piston and said percussive member may be alternately pressurized and exhausted through said percussive member to impart a reciprocating movement to said piston; and said piston imparts an impact to said percussive member.

26. A percussive apparatus comprising:

a casing;

a coupling means disposed at one end of said casing for connecting said apparatus to a source of pressure fluid;

a percussive means disposed at the other end of said casing for receiving an impact and imparting the impact to a work media;

a piston disposed in said casing to reciprocate therein intermediate said coupling means and said percussive means and impart an impact on said percussive means;

said piston having a first portion facing towards said one end and a second portion facing towards said one end;

a porting means cooperating with said piston for transporting pressure fluid to said piston and for continuously pressurizing said first portion of said piston and for alternately pressurizing said second portion of said piston and the end of said piston facing towards said percussive means to thereby cause said piston to reciprocate;

said piston is a stepped piston having a lesser diameter forming the second portion of the piston located towards one end and a greater diameter located towards the other end connected by a land defining a shoulder forming the first portion of the piston between the diameters;

said porting means comprises a cylinder sleeve disposed in said casing at said one end of said casing;

said cylinder sleeve forming an annular passage with said casing; and said annular passage terminating at the end of the sleeve to form a substantially annular outlet facing towards said shoulder to apply to said shoulder an unobstructed flow of pressure fluid flowing in a direction parallel to the direction of reciprocation of said piston.

27. The apparatus of claim 26 wherein:

said apparatus is a rock drill and said percussive means is a rock cutting bit.

28. The apparatus of claim 26 wherein:

said lesser diameter of said piston is in sliding contact with said cylinder sleeve and said piston and cylinder sleeve are adapted to guide said piston and to direct pressure fluid flow to the second portion of said piston at one end.

29. The apparatus of claim 26 wherein:

said piston and said casing are adapted to cooperate in sliding contact to intermittently supply pressure fluid to the other end of said piston.

30. A percussive apparatus comprising:

a casing;

a coupling means disposed at one end of said casing for connecting said apparatus to a source of pressure fluid;

a percussive means disposed at the other end of said casing for receiving an impact and imparting the impact to a work media;

a piston disposed in said casing to reciprocate therein intermediate said coupling means and said percussive means and impart an impact on said percussive means;

said piston having a first portion facing towards said one end and a second portion facing towards said one end;

a porting means cooperating with said piston for continuously pressurizing said first portion of said piston and for alternately pressurizing said second portion of said piston and the end of said piston means facing towards said percussive means to thereby cause said piston to reciprocate;

said piston is a stepped piston having a lesser diameter forming the second portion of the piston located towards one end and a greater diameter located towards the other end connected by a land defining a shoulder forming the first portion of the piston between the diameters; and said piston cooperates with a finger valve at its one end and an exhaust tube at its other end to effect pressurization and exhaust at alternate ends of said piston.

* * * * *